United States Patent [19]

Aja et al.

[11] 4,017,933

[45] Apr. 19, 1977

[54] TYPEBALL CLEANING APPARATUS

[76] Inventors: Raymond A. Aja, 2 Murray Road, Essex Junction, Vt. 05452; Alphonse C. Dufault, 1835 North Ave., Burlington, Vt. 05401

[22] Filed: May 14, 1976

[21] Appl. No.: 686,647

[52] U.S. Cl. ..... 15/21 A; 15/21 B; 15/160; 134/149; 197/184

[51] Int. Cl.[2] ..... A46B 11/00; B41J 29/00

[58] Field of Search ..... 15/21 A, 21 B, 38, 104.92, 15/160; 197/84, 85

[56] References Cited

UNITED STATES PATENTS

| | | | |
|---|---|---|---|
| 1,573,720 | 2/1926 | Lampson | 15/21 B |
| 1,683,458 | 9/1928 | Hall | 15/21 B |
| 2,156,594 | 5/1939 | Lester | 134/149 |
| 3,271,802 | 9/1966 | Thompson | 15/160 |
| 3,740,784 | 6/1973 | Morrissey | 15/21 A |

*Primary Examiner*—Daniel Blum
*Attorney, Agent, or Firm*—LeBlanc & Shur

[57] ABSTRACT

A typeball cleaning apparatus is provided for cleaning typewriter and terminal typeballs of the type having a bore therein with an engaging mechanism in the bore for engaging a mounting on the typewriter or terminal. The apparatus includes a container having an open top. A plurality of brushes have one end mounted on the interior sides of the container with the other end of each of the brushes extending towards the axis of the container. A top member with an aperture therethrough covers the container. A crank is provided which has an engaging portion which passes through the aperture in the top member into the container. The engaging portion is insertable into the bore in the typeball and engages the engaging mechanism in the typeball. The crank also includes a handle portion which is on the exterior of the container for turning the crank.

6 Claims, 4 Drawing Figures

TYPEBALL CLEANING APPARATUS

BACKGROUND OF THE INVENTION

1. FIELD OF THE INVENTION

This invention is related to a typeball cleaner and more particularly to a typeball cleaner which has a plurality of brushes within a container filled with a cleaning solvent and a crank which has an engaging portion for engaging the engaging mechanism in the typeball so that the typeball can be inserted in the container and rotated by turning the crank such that its type face contacts the brushes whereby the typeball is cleaned.

2. DESCRIPTION OF THE PRIOR ART

Conventional techniques for cleaning typewriter typeballs involve the use of a ball of putty and/or a typewriter brush. The putty is manually applied to the type face of the ball and then is removed. Some of the ink and dirt which has accumulated on the ball adheres to the putty and thus is removed from the typeball. A typewriter bursh can then be used to remove additional dirt and ink. This technique is very time-consuming, tedious, extremely messy and very inefficient.

Prior art devices for cleaning spheroids, such as a golf ball, are also well known. However, since a golf ball is a solid sphere, the prior art devices include complicated mechanisms for rotating the golf ball within the cleaning container. Typical examples of prior art golf ball cleaners can be found in the following U.S. Patents: Pat. No. 3,006,009; Pat. No. 3,119,134; Pat. No. 3,210,789; Pat. No. 3,380,095; Pat. No. 3,462,230; Pat. No. 3,740,784.

SUMMARY OF THE INVENTION

It is the primary object of the present invention to provide an apparatus for cleaning typewriter and terminal typeballs.

It is another object of the present invention to provide a typeball cleaning apparatus in which the typeball is rotated in a container having plurality of brushes which contact the type face of the ball.

It is still another object of the present invention to provide a typeball cleaning apparatus which includes a crank having an engaging portion which is insertable into the bore of the typeball and which engages the engaging mechanism in the typeball wherein the crank is used to rotate the ball within a container having a plurality of brushes which engage the type face of the ball.

It is still a further object of the present invention to provide a typeball cleaning apparatus having brushes mounted within a four-sided container wherein each of the brushes is mounted on one of the sides of the container.

It is still another object of the present invention to provide a typeball cleaning apparatus having a container with four sides and brushes within the container wherein each of the brushes is mounted between two adjacent sides of the container.

The present invention is directed to a typeball cleaning apparatus for cleaning typewriter and terminal typeballs of the type which have a bore therein with an engaging mechanism in the bore for engaging a mounting on the typewriter or terminal. The apparatus comprises a container having an open-top with a plurality of brushes within the container. Each of the brushes has one end mounted on the interior sides of the container while the other end extends towards the axis of the container. A top member, having an aperture therein, covers the container. A crank which has an engaging portion passes through the aperture in the top member into the container. The engaging portion of the crank is insertable into the bore in the typeball and engages the engaging mechanism in the typeball. The crank also includes a handle for turning the crank and thereby a typeball which is engaged by the engaging portion of the crank. The brushes are positioned within the container to contact the type face of the typeball and thus upon rotation of the crank, the typeball will rotate and the type face will be cleaned by the movement of the type face against the brushes. The container is filled with a cleaning solvent to assist in the cleaning of the typeballs.

DETAILED DESCRIPTION OF THE PREFERRED EMBODIMENTS

Figure 1:
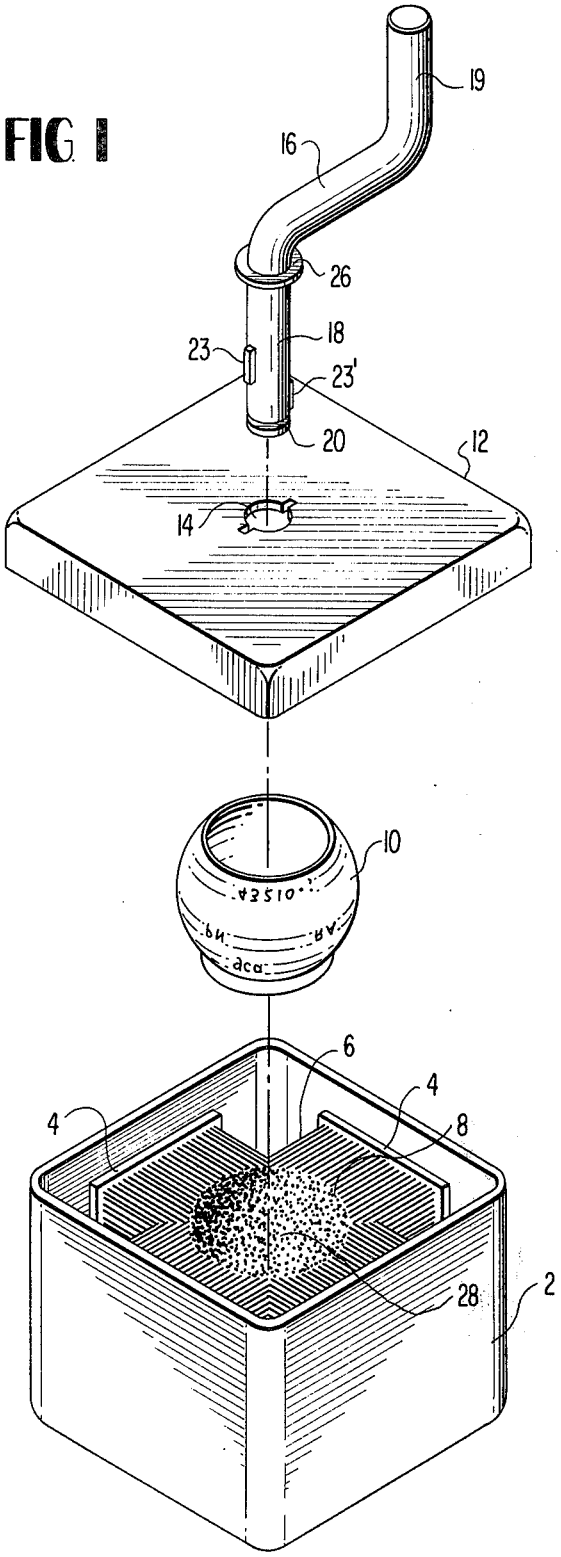
FIG. 1 is an exploded perspective view of the typeball cleaning apparatus of the present invention.
Figure 2:
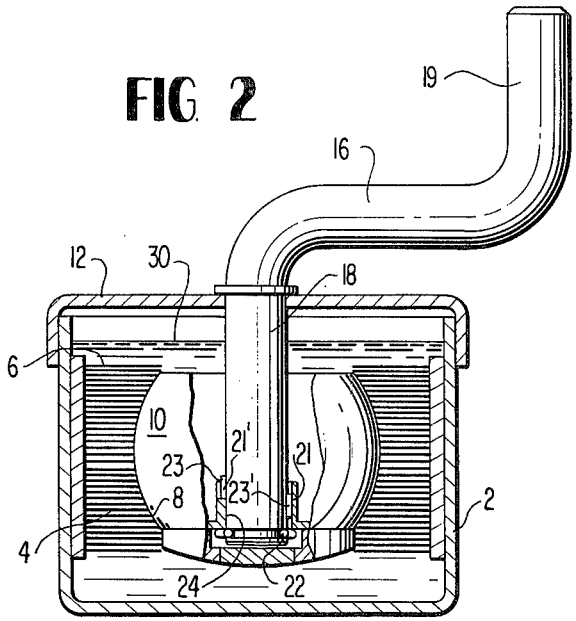
FIG. 2 is a side section view of the present invention.
Figure 3:
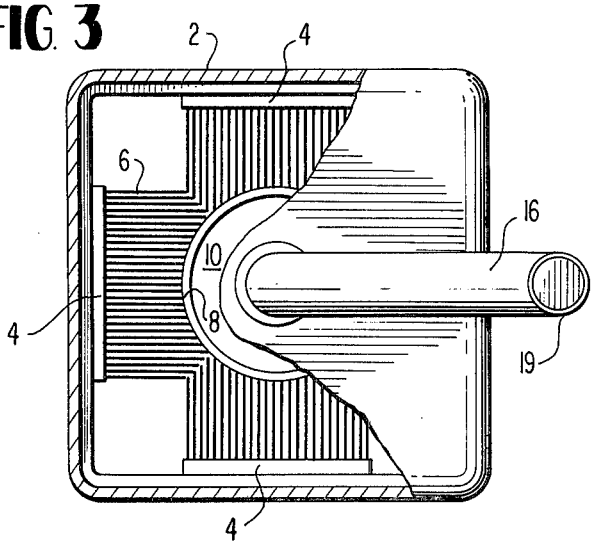
FIG. 3 is a partial cutaway top view showing one embodiment of the present invention.

Referring to FIGS. 1–3, the typeball cleaner comprises a water-proof container 2. Brushes 4 are mounted on the interior side of the walls of the container 2. Each of the brushes 4 includes a plurality of bristles 6. The ends 8 of the bristles 6 are cut so that the end of the brush conforms generally to the shape of the typeball 10 but forms an opening smaller than the typeball 10 so that the bristles engage the typeball under pressure to ensure good cleaning action. While the bristles in the drawings are shown as entirely encompassing the typeballs, it will be understood that this is not necessary in view of the rotation of the typeball within the bristles during the cleaning operation. A cover member 12 with an aperture 14 therein fits over the top of the container 2. The aperture 14 contains notches 15 and 17 to receive lugs 23 and 23' presently to be described.

The cleaning apparatus also includes a crank 16 having an engaging portion 18 and a handle portion 19. The engaging portion 18 includes an end portion 20 which is formed to engage the engaging mechanism 22 of the typeball 10. The engaging portion 18 also includes lugs 23 and 23' which are received in slots 21 and 21' in typeball 10. This provides a locking action to cause the typeball to rotate when the crank is turned.

Typeballs of the type used in typewriters and terminals have a bore 24 which extends from the bottom of the ball to the interior thereof with the engaging mechanism 22 being located at the end of the bore 24. The typeball is mounted on the typewriter or terminal device (not shown) by inserting a mounting mechanism on the typewriter or terminal device into the bore and engaging the mounting mechanism with the engaging mechanism 22 of the typeball. When cleaning a typeball using the apparatus of the present invention, the typeball is mounted on the crank 16 by placing the engaging portion 18 into the bore 24 so that end 20 engages engaging portion 22 of the typeball 10 and the lugs 23 and 23' are received in slots 21 and 21' as previously described thereby mounting the typeball 10 on the end of the crank 16 in the same manner as the ball is mounted on a typewriter or terminal.

The crank 16 also includes a stopper 26 mounted on engaging portion 18. When a typeball is being cleaned the crank 16 is inserted through aperture 14 until the stopper 26 rests against the outer surface of cover member 12. Then the engaging portion 18 is inserted into the bore 24 of ball 10 with end 20 engaging the engaging mechanism 22 within the typeball and the lugs 23 and 23' entering slots 21 and 21'. The cover member 12 is then placed on container 2 whereby the ball 10 is inserted into space 28 formed by ends 8 of the brushes 4. The crank 16 is then rotated causing the ball 10 to rotate so that the ends 8 of bristles 6 contact the type face of the ball 10. Prior to insertion of the ball 10, the container 2 is filled with a liquid cleaning solvent 30. The solvent may be an all-purpose cleaner, such as a suitable solvent. While FIG. 2 shows the level of solvent being above the typeball, this is not necessary so long as the bristles are wetted to a sufficient height to reach the uppermost portion of the typeball.

Figure 4:
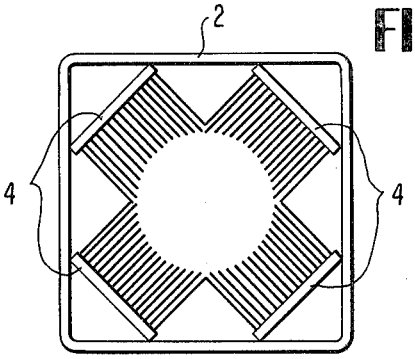
FIG. 4 is a top view showing an alternate embodiment of the present invention.

In the embodiment shown in FIGS. 1–3, each brush 4 is mounted on one side of the container 2. In an alternate embodiment shown in FIG. 4, each brush 2 is mounted between two adjacent sides being positioned on a diagonal between the sides.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A typeball cleaning apparatus for cleaning typewriter and terminal typeballs of the type having a bore therein with an engaging mechanism in the bore for engaging a mounting on the typewriter or terminal, said apparatus comprising:

a. a liquid container having an open top;

b. a plurality of brushes having one end mounted on the interior sides of said container, and the other end extending toward the axis of the container;

c. a top means for covering said container said top means having an aperture therein; and d. a crank having an engaging portion means, which passes through the aperture in said top means into said container, for insertion into the bore in said typeball for engaging and coupling with the engaging mechanism in the typeball, and a handle for turning said crank wherein when said crank is turned, a typeball coupled therewith is rotated such that its type face contacts said brushes whereby it is cleaned.

2. The apparatus of claim 1, wherein said container has four sides and one of said plurality of brushes is mounted on each of said sides.

3. The apparatus of claim 1, wherein said container has four sides and each of said plurality of brushes is mounted between two adjacent sides.

4. The apparatus of claim 1, wherein said crank includes a stopper mounted on said engaging portion means, said stopper contacting the outside surface of said top means thereby preventing the insertion of said engaging portion means into said container by more than a predetermined amount.

5. The apparatus of claim 1, wherein the distance between said other ends of each of said brushes provides an opening smaller than the dimensions of the typeball whereby said brushes engage said typeball under pressure.

6. The apparatus of claim 5, wherein said other ends of each of said brushes are curved, the curvature corresponding to the curvature of the typeball.

* * * * *